US011473814B2

(12) United States Patent
Zha

(10) Patent No.: US 11,473,814 B2
(45) Date of Patent: Oct. 18, 2022

(54) INTEGRATED COOLING SYSTEM WITH FLOODED AIR CONDITIONING HEAT EXCHANGER

(71) Applicant: Heatcraft Refrigeration Products LLC, Stone Mountain, GA (US)

(72) Inventor: Shitong Zha, Snellville, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 263 days.

(21) Appl. No.: 16/720,923

(22) Filed: Dec. 19, 2019

(65) Prior Publication Data

US 2020/0363102 A1 Nov. 19, 2020

Related U.S. Application Data

(60) Provisional application No. 62/846,824, filed on May 13, 2019.

(51) Int. Cl.
*F25B 5/02* (2006.01)
*F25B 40/02* (2006.01)
(Continued)

(52) U.S. Cl.
CPC ..... *F25B 5/02* (2013.01); *F25B 7/00* (2013.01); *F25B 25/00* (2013.01); *F25B 31/00* (2013.01);
(Continued)

(58) Field of Classification Search
CPC .. F25B 7/00; F25B 41/20; F25B 25/00; F25B 31/00; F25B 40/02; F25B 43/006;
(Continued)

(56) References Cited

U.S. PATENT DOCUMENTS 5,056,329 A * 10/1991 Wilkinson ..... F25B 9/006 62/197
8,561,425 B2 * 10/2013 Mitra ..... F25B 9/008 62/498
8,671,703 B2 * 3/2014 Mitra ..... F25B 1/10 62/509
9,625,183 B2 * 4/2017 Wallace ..... F25B 9/008
(Continued)

FOREIGN PATENT DOCUMENTS

EP 1215450 A1 6/2002
EP 3156742 A1 4/2017
(Continued)

OTHER PUBLICATIONS

European Patent Office, Extended European Search Report, Application No. 20152342.0, dated Jul. 22, 2020, 8 pages.

*Primary Examiner* — Miguel A Diaz
(74) *Attorney, Agent, or Firm* — Baker Botts L.L.P.

(57) ABSTRACT

An integrated system floods an air conditioning low side heat exchanger such that the air conditioning low side heat exchanger does not evaporate all the liquid refrigerant entering the air conditioning low side heat exchanger. As a result, both liquid and vapor refrigerant leave the air conditioning low side heat exchanger. The system includes an additional receiver that stores the refrigerant leaving the air conditioning low side heat exchanger. To prevent the liquid refrigerant in the receiver from overflowing, the liquid refrigerant in the receiver is used in a refrigeration system when the level of liquid refrigerant in the receiver exceeds a threshold (e.g., as detected by a sensor in the receiver).

20 Claims, 4 Drawing Sheets

(51) Int. Cl.

| | |
|---|---|
| ***F25B 43/00*** | (2006.01) |
| ***F25B 41/20*** | (2021.01) |
| ***F25B 41/385*** | (2021.01) |
| ***F25B 7/00*** | (2006.01) |
| ***F25B 25/00*** | (2006.01) |
| ***F25B 31/00*** | (2006.01) |
| ***F25B 41/39*** | (2021.01) |

(52) U.S. Cl.
CPC ..... *F25B 40/02* (2013.01); *F25B 41/20* (2021.01); *F25B 41/385* (2021.01); *F25B 41/39* (2021.01); *F25B 43/006* (2013.01); *F25B 2400/051* (2013.01); *F25B 2400/061* (2013.01); *F25B 2400/13* (2013.01); *F25B 2400/161* (2013.01); *F25B 2400/22* (2013.01); *F25B 2400/23* (2013.01); *F25B 2600/2501* (2013.01); *F25B 2600/2509* (2013.01); *F25B 2600/2519* (2013.01)

(58) Field of Classification Search
CPC ..... F25B 2400/051; F25B 2400/061; F25B 2400/13; F25B 2400/16; F25B 2400/161; F25B 2400/22; F25B 2400/23; F25B 2600/2501; F25B 2600/2509; F25B 2600/2519; F25B 2600/2523; F25B 1/00; F25B 1/10; F25B 5/00; F25B 5/02; F25B 5/04
See application file for complete search history.

(56) References Cited

U.S. PATENT DOCUMENTS

| | | | | |
|---|---|---|---|---|
| 9,689,590 | B2 * | 6/2017 | Christensen | F25B 9/008 |
| 9,803,897 | B2 * | 10/2017 | Furui | F25B 40/00 |
| 10,365,023 | B2 * | 7/2019 | Zha | F25B 1/10 |
| 10,502,461 | B2 * | 12/2019 | Christensen | F25B 9/008 |
| 11,029,068 | B2 * | 6/2021 | Christensen | F25B 49/022 |
| 2010/0115975 | A1 * | 5/2010 | Mitra | F25B 1/10 62/196.1 |
| 2011/0023514 | A1 * | 2/2011 | Mitra | B60H 1/3228 62/222 |
| 2013/0298593 | A1 * | 11/2013 | Christensen | F25B 1/10 62/467 |
| 2014/0208785 | A1 * | 7/2014 | Wallace | F25B 49/02 62/115 |
| 2016/0102901 | A1 * | 4/2016 | Christensen | F25B 49/022 62/117 |
| 2017/0205120 | A1 * | 7/2017 | Ali | F25B 40/00 |
| 2018/0156513 | A1 * | 6/2018 | Javerschek | F25B 49/022 |
| 2018/0216851 | A1 * | 8/2018 | Christensen | F25B 5/00 |
| 2019/0072305 | A1 * | 3/2019 | Zha | F25B 1/10 |
| 2019/0086130 | A1 * | 3/2019 | Hellmann | F25B 5/02 |
| 2019/0368786 | A1 * | 12/2019 | Newel | F25B 40/02 |
| 2020/0191457 | A1 * | 6/2020 | Zha | F25B 47/02 |
| 2020/0363109 | A1 * | 11/2020 | Sun | F25B 43/006 |

FOREIGN PATENT DOCUMENTS

| | | | |
|---|---|---|---|
| EP | 3453993 | A2 | 3/2019 |
| EP | 3453993 | A3 | 6/2019 |
| WO | 2014100330 | A1 | 6/2014 |

* cited by examiner

INTEGRATED COOLING SYSTEM WITH FLOODED AIR CONDITIONING HEAT EXCHANGER

RELATED APPLICATIONS AND CLAIM TO PRIORITY

This application claims priority to U.S. Provisional Application No. 62/846,824 filed May 13, 2019 and titled "COOLING SYSTEM," which is incorporated herein by reference.

TECHNICAL FIELD

This disclosure relates generally to a cooling system.

BACKGROUND

Cooling systems are used to cool spaces, such as residential dwellings, commercial buildings, and/or refrigeration units. These systems cycle a refrigerant (also referred to as charge) that is used to cool the spaces.

SUMMARY

Certain commercial cooling installations (e.g., in grocery stores) are cooling systems that integrate an air conditioning system and a refrigeration system. In these systems, the air conditioning system and the refrigeration system share refrigerant and certain components (e.g., a high side heat exchanger and receiver). By sharing refrigerant and components between the air conditioning and refrigeration systems, these integrated systems have a smaller footprint compared to installations that have separate air conditioning and refrigeration systems. However, due to the efficiency gains from having separate systems, the integrated systems perform less efficiently (e.g., 8% less efficient) than separate systems in certain instances (e.g., during hot days).

This disclosure contemplates an integrated system with certain, unconventional modifications that improve the efficiency of the integrated system. The integrated system floods an air conditioning low side heat exchanger such that the air conditioning low side heat exchanger does not evaporate all the liquid refrigerant entering the air conditioning low side heat exchanger. As a result, both liquid and vapor refrigerant leave the air conditioning low side heat exchanger. The system includes an additional receiver that stores the refrigerant leaving the air conditioning low side heat exchanger. To prevent the liquid refrigerant in the receiver from overflowing, the liquid refrigerant in the receiver is used in the refrigeration system when the level of liquid refrigerant in the receiver exceeds a threshold (e.g., as detected by a sensor in the receiver). The vapor refrigerant in the receiver is directed to a compressor. By flooding the air conditioning low side heat exchanger and using the residual liquid refrigerant in the refrigeration system, the efficiency of the system is improved. In some instances, the system performs as efficiently as separate air conditioning and refrigeration systems on hot days. Certain embodiments of the unconventional system are described below.

According to an embodiment, an apparatus includes a high side heat exchanger, an air conditioning low side heat exchanger, a first receiver, a second receiver, a first low side heat exchanger, a second low side heat exchanger, a first valve, a second valve, a first compressor, a second compressor, and a third compressor. The high side heat exchanger removes heat from a refrigerant. The air conditioning low side heat exchanger uses the refrigerant from the high side heat exchanger to cool a space proximate the air conditioning low side heat exchanger. The first receiver stores the refrigerant from the air conditioning low side heat exchanger. The refrigerant from the air conditioning low side heat exchanger includes a liquid portion and a vapor portion. The second receiver stores the refrigerant from the high side heat exchanger. The first valve controls a flow of the liquid portion of the refrigerant from the first receiver to the first and second low side heat exchangers. The second valve controls a flow of the refrigerant from the second receiver to the first and second low side heat exchangers. The first compressor compresses the refrigerant from the first low side heat exchanger. The second compressor compresses the refrigerant from the first compressor and the second low side heat exchanger. The third compressor compresses the vapor portion of the refrigerant from the first receiver. During a first mode of operation: the first valve is closed, the second valve is open, the first low side heat exchanger uses the refrigerant from the second receiver to remove heat from a first space proximate the first low side heat exchanger, and the second low side heat exchanger uses the refrigerant from the second receiver to remove heat from a second space proximate the second low side heat exchanger. During a second mode of operation: the first valve is open, the second valve is closed, the first low side heat exchanger uses the liquid portion of the refrigerant from the first receiver to remove heat from the first space, and the second low side heat exchanger uses the liquid portion of the refrigerant from the first receiver to remove heat from the second space.

According to another embodiment, a method includes removing, by a high side heat exchanger, heat from a refrigerant, using, by an air conditioning low side heat exchanger, the refrigerant from the high side heat exchanger to cool a space proximate the air conditioning low side heat exchanger, and storing, by a first receiver, the refrigerant from the air conditioning low side heat exchanger. The refrigerant from the air conditioning low side heat exchanger includes a liquid portion and a vapor portion. The method also includes storing, by a second receiver, the refrigerant from the high side heat exchanger, controlling, by a first valve, a flow of the liquid portion of the refrigerant from the first receiver to a first low side heat exchanger and a second low side heat exchanger, and controlling, by a second valve, a flow of the refrigerant from the second receiver to the first and second low side heat exchangers. The method further includes compressing, by a first compressor, the refrigerant from the first low side heat exchanger, compressing, by a second compressor, the refrigerant from the first compressor and the second low side heat exchanger, and compressing, by a third compressor, the vapor portion of the refrigerant from the first receiver. The method also includes using, by the first low side heat exchanger, the refrigerant from the second receiver to remove heat from a first space proximate the first low side heat exchanger during a first mode of operation and using, by the second low side heat exchanger, the refrigerant from the second receiver to remove heat from a second space proximate the second low side heat exchanger during the first mode of operation. The first valve is closed and the second valve is open during the first mode of operation. The method further includes using, by the first low side heat exchanger, the liquid portion of the refrigerant from the first receiver to remove heat from the first space during a second mode of operation and using, by the second low side heat exchanger, the liquid portion of the refrigerant from the first receiver to remove heat from the second space during the second mode of operation. The first valve is open and the second valve is closed during the second mode of operation.

According to yet another embodiment, a system includes a high side heat exchanger, an air conditioning low side heat exchanger, a receiver, a first low side heat exchanger, a second low side heat exchanger, a first compressor, a second compressor, and a third compressor. The high side heat exchanger removes heat from a refrigerant. The air conditioning low side heat exchanger uses the refrigerant from the high side heat exchanger to cool a space proximate the air conditioning low side heat exchanger. The receiver stores the refrigerant from the air conditioning low side heat exchanger and the refrigerant from the high side heat exchanger. The refrigerant from the air conditioning low side heat exchanger includes a liquid portion and a vapor portion. The first low side heat exchanger uses the refrigerant from the receiver to cool a first space proximate the first low side heat exchanger. The second low side heat exchanger uses the refrigerant from the receiver to cool a second space proximate the second low side heat exchanger. The first compressor compresses the refrigerant from the first low side heat exchanger. The second compressor compresses the refrigerant from the first compressor and the second low side heat exchanger. The third compressor compresses a vapor portion of the refrigerant from the receiver.

Certain embodiments provide one or more technical advantages. For example, an embodiment improves the efficiency of an integrated air conditioning and refrigeration system by flooding the air conditioning low side heat exchanger. As another example, an embodiment improves the efficiency of an integrated air conditioning and refrigeration system by using heat exchangers to subcool refrigerant from an air conditioning low side heat exchanger and a refrigeration low side heat exchanger. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
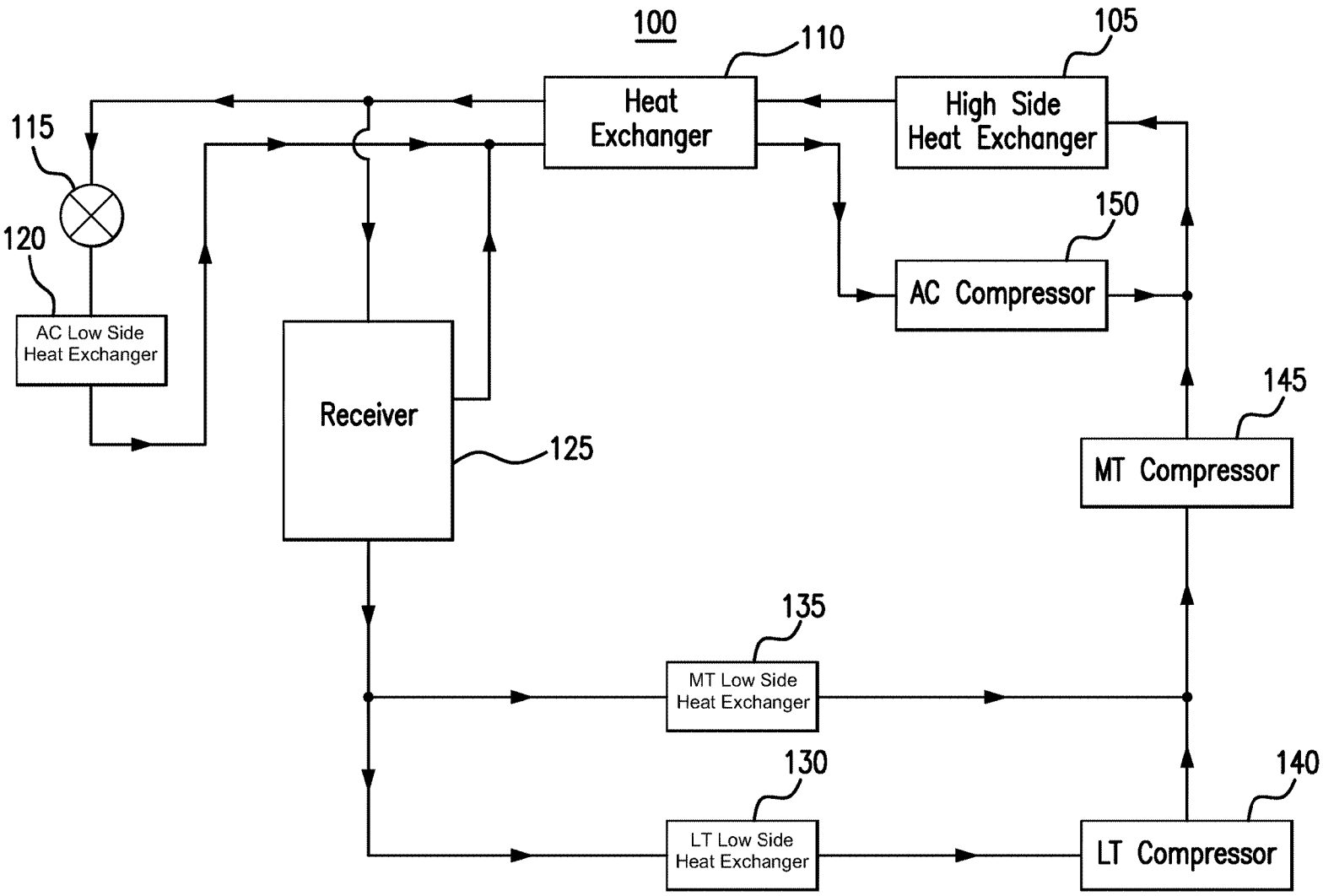
FIG. 1 illustrates an example cooling system.
Figure 2A:
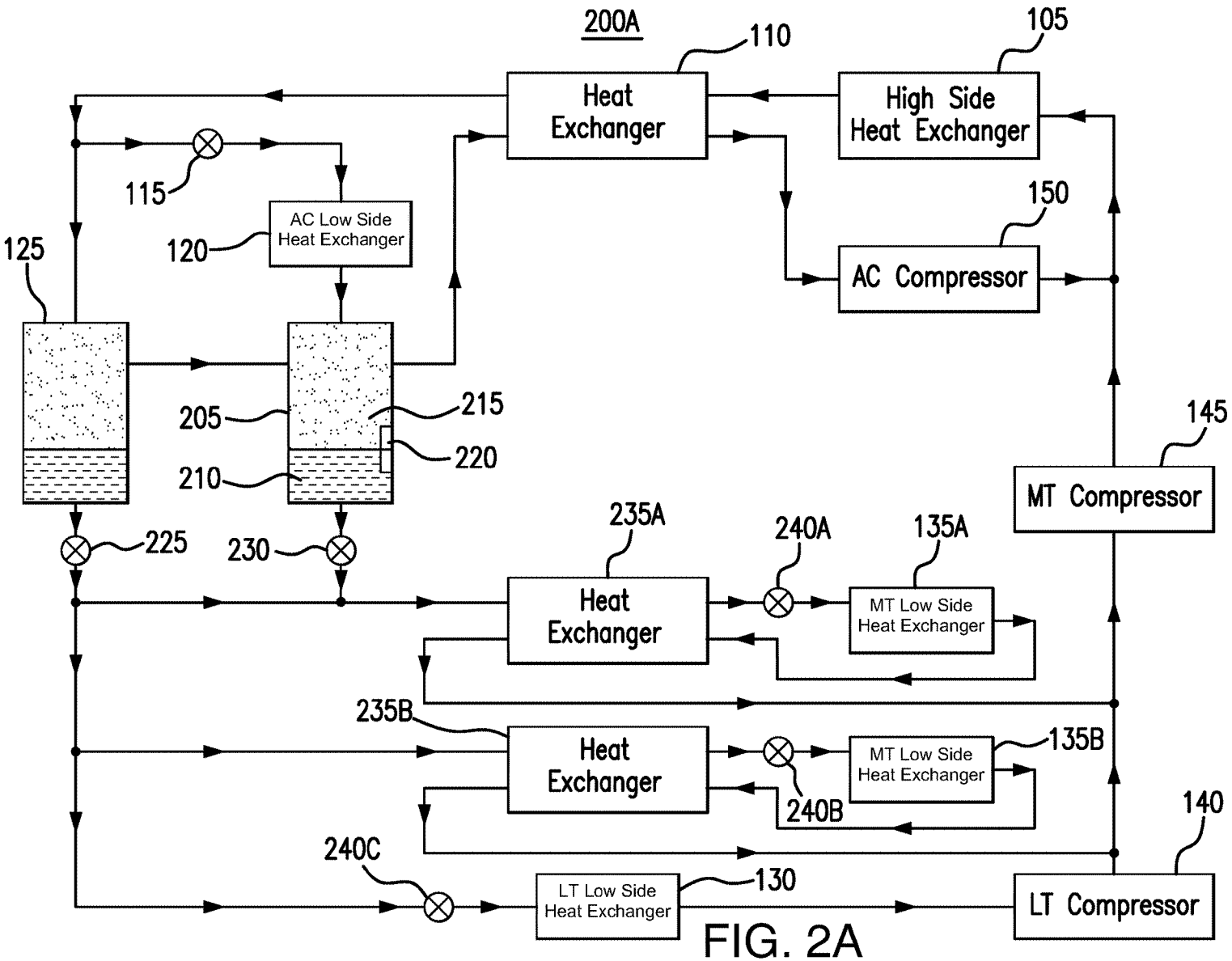
FIG. 2A illustrates an example cooling system.
Figure 2B:
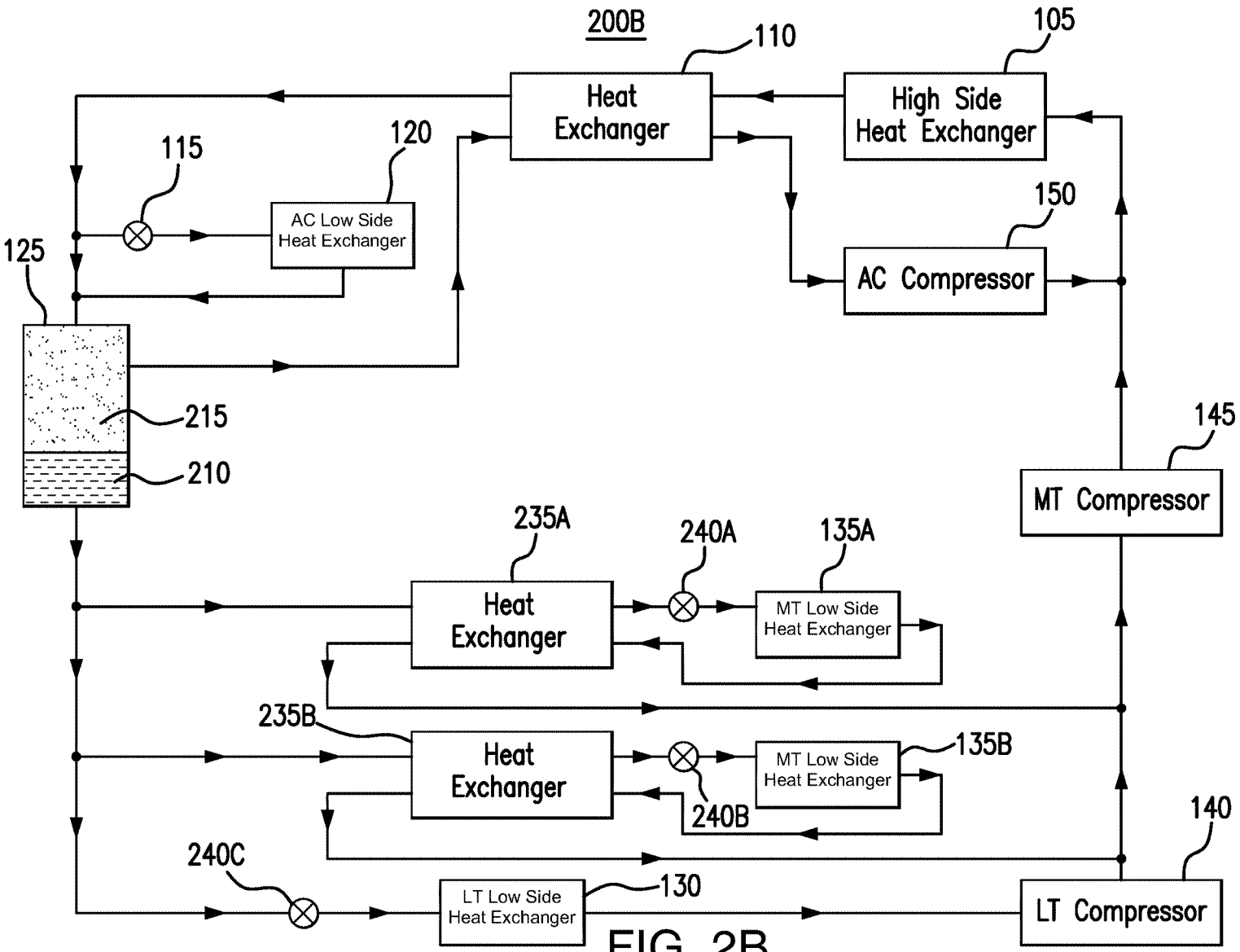
FIG. 2B illustrates an example cooling system.
Figure 3:
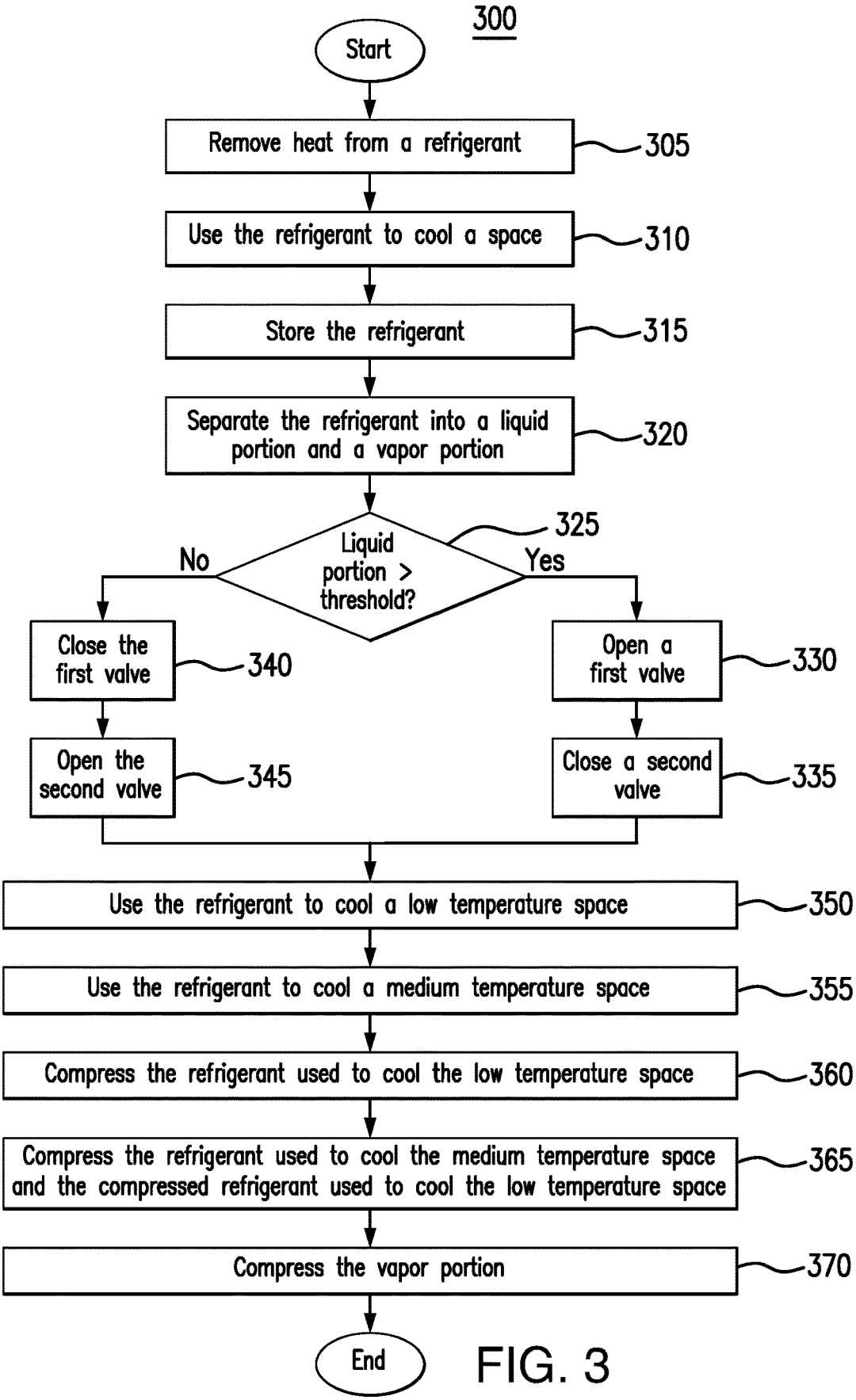
FIG. 3 is a flowchart illustrating a method of operating an example cooling system.

Embodiments of the present disclosure and its advantages are best understood by referring to FIGS. 1 through 3 of the drawings, like numerals being used for like and corresponding parts of the various drawings.

Certain commercial cooling installations (e.g., in grocery stores) are cooling systems that integrate an air conditioning system and a refrigeration system. In these systems, the air conditioning system and the refrigeration system share refrigerant and certain components (e.g., a high side heat exchanger and receiver). By sharing refrigerant and components between the air conditioning and refrigeration systems, these integrated systems have a smaller footprint compared to installations that have separate air conditioning and refrigeration systems. However, due to the efficiency gains from having separate systems, the integrated systems perform less efficiently (e.g., 8% less efficient) than separate systems in certain instances (e.g., during hot days).

This disclosure contemplates an integrated system with certain, unconventional modifications that improve the efficiency of the integrated system. The integrated system floods an air conditioning low side heat exchanger such that the air conditioning low side heat exchanger does not evaporate all the liquid refrigerant entering the air conditioning low side heat exchanger. As a result, both liquid and vapor refrigerant leave the air conditioning low side heat exchanger. The system includes an additional receiver that stores the refrigerant leaving the air conditioning low side heat exchanger. To prevent the liquid refrigerant in the receiver from overflowing, the liquid refrigerant in the receiver is used in the refrigeration system when the level of liquid refrigerant in the receiver exceeds a threshold (e.g., as detected by a sensor in the receiver). The vapor refrigerant in the receiver is directed to a compressor. By flooding the air conditioning low side heat exchanger and using the residual liquid refrigerant in the refrigeration system, the efficiency of the system is improved. In some instances, the system performs as efficiently as separate air conditioning and refrigeration systems on hot days.

In certain embodiments, the system improves efficiency by flooding the air conditioning low side heat exchanger. In some embodiments, the system improves efficiency by using heat exchangers to subcool refrigerant from an air conditioning low side heat exchanger and a refrigeration low side heat exchanger. The cooling system will be described using FIGS. 1 through 3. FIG. 1 will describe an existing cooling system. FIGS. 2A, 2B, and 3 describe the cooling system with a flooded air conditioning low side heat exchanger.

FIG. 1 illustrates an example cooling system 100. As seen in FIG. 1, system 100 includes a high side heat exchanger 105, a heat exchanger 110, an expansion valve 115, an air conditioning low side heat exchanger 120, a receiver 125, a low temperature low side heat exchanger 130, a medium temperature low side heat exchanger 135, a low temperature compressor 140, a medium temperature compressor 145, and an air conditioning compressor 150. System 100 integrates an air conditioning system and a refrigeration system. As seen in FIG. 1, air conditioning low side heat exchanger 120, low temperature low side heat exchanger 130, and medium temperature low side heat exchanger 135 share refrigerant and other components of system 100 such as high side heat exchanger 105 and receiver 125. By sharing refrigerant and components of system 100, the footprint of system 100 is reduced when compared to separate air conditioning and refrigeration systems.

High side heat exchanger 105 removes heat from a refrigerant (e.g., carbon dioxide). When heat is removed from the refrigerant, the refrigerant is cooled. This disclosure contemplates high side heat exchanger 105 being operated as a condenser and/or a gas cooler. When operating as a condenser, high side heat exchanger 105 cools the refrigerant such that the state of the refrigerant changes from a gas to a liquid. When operating as a gas cooler, high side heat exchanger 105 cools gaseous refrigerant and the refrigerant remains a gas. In certain configurations, high side heat exchanger 105 is positioned such that heat removed from the refrigerant may be discharged into the air. For example, high side heat exchanger 105 may be positioned on a rooftop so that heat removed from the refrigerant may be discharged into the air. As another example, high side heat exchanger 105 may be positioned external to a building and/or on the side of a building. This disclosure contemplates any suitable refrigerant (e.g., carbon dioxide) being used in any of the disclosed cooling systems.

Heat exchanger 110 receives refrigerant from high side heat exchanger 105. Heat exchanger 110 also receives refrigerant from air conditioning low side heat exchanger 120 and/or receiver 125. Heat exchanger 110 transfers heat from the refrigerant from air conditioning low side heat exchanger 120 and/or the refrigerant from receiver 125 to the refrigerant from high side heat exchanger 105. In this manner, the refrigerant from air conditioning low side heat exchanger 120 and/or the refrigerant from receiver 125 is sub-cooled by the refrigerant from high side heat exchanger 105. Heat exchanger 110 then directs the refrigerant from air conditioning low side heat exchanger 120 and/or the refrigerant from receiver 125 to air conditioning compressor 150. In this manner, the refrigerant directed to air conditioning compressor 150 is cooler than the refrigerant from air conditioning low side heat exchanger 120 and/or the refrigerant from receiver 125. As a result, the efficiency of air conditioning compressor 150 is improved.

Expansion valve 115 controls a flow of refrigerant. For example, when expansion valve 115 is opened, refrigerant flows through expansion valve 115. When expansion valve 115 is closed, refrigerant stops flowing through expansion valve 115. In certain embodiments, expansion valve 115 can be opened to varying degrees to adjust the amount of flow of refrigerant. For example, expansion valve 115 may be opened more to increase the flow of refrigerant. As another example, expansion valve 115 may be opened less to decrease the flow of refrigerant. Thus, expansion valve 115 directs refrigerant from high side heat exchanger 105 to air conditioning low side heat exchanger 120.

Expansion valve 115 is used to cool refrigerant flowing through expansion valve 115. Expansion valve 115 may receive refrigerant from any component of system 200 such as for example high side heat exchanger 105 and/or heat exchanger 110. Expansion valve 115 reduces the pressure and therefore the temperature of the refrigerant. Expansion valve 115 reduces pressure from the refrigerant flowing into the expansion valve 115. The temperature of the refrigerant may then drop as pressure is reduced. As a result, refrigerant entering expansion valve 115 may be cooler when leaving expansion valve 115.

Air conditioning low side heat exchanger 120 uses refrigerant from high side heat exchanger 105 to cool a space proximate air conditioning low side heat exchanger 120. For example, air conditioning low side heat exchanger 120 may send refrigerant through metallic coils that are cooled by the refrigerant. The coils then cool the air around the coils. A blower or fan may then circulate the cool air throughout a space to cool the space. This disclosure contemplates air conditioning low side heat exchanger 120 including any components that cool a space using refrigerant. For example, air conditioning low side heat exchanger 120 may include a heat exchanger that transfers heat from one solution to the refrigerant. The solution is then cooled and may be used to cool a space. As another example, air conditioning low side heat exchanger 120 may include plates or fins that are cooled by the refrigerant. This disclosure contemplates air conditioning low side heat exchanger 120 including any components that use refrigerant to cool a space. Air conditioning low side heat exchanger 120 directs refrigerant to heat exchanger 110.

Receiver 125 stores refrigerant received from high side heat exchanger 105. This disclosure contemplates receiver 125 storing refrigerant in any state such as, for example, a liquid state and/or a vapor state. Refrigerant leaving receiver 125 is fed to low temperature low side heat exchanger 130 and medium temperature low side heat exchanger 135. In some embodiments, a flash gas and/or a vapor refrigerant is released from receiver 125 to heat exchanger 110 and air conditioning compressor 150. By releasing flash gas, the pressure within receiver 125 may be reduced.

Receiver 125 may store refrigerant in both a liquid and a vapor form. For example, refrigerant entering receiver 125 may include both a liquid component and a vapor component. In some instances, the refrigerant entering receiver 125 may include only a liquid component, but as the refrigerant is stored in receiver 125, some of the liquid refrigerant evaporates and becomes a vapor in receiver 125. Receiver 125 discharges the vapor portion of the refrigerant in receiver 125 to heat exchanger 110. In this manner, the internal pressure of receiver 125 can be controlled.

System 100 includes a refrigeration system with a low temperature portion and a medium temperature portion. The low temperature portion operates at a lower temperature than the medium temperature portion. In some refrigeration systems, the low temperature portion may be a freezer system and the medium temperature system may be a regular refrigeration system. In a grocery store setting, the low temperature portion may include freezers used to hold frozen foods, and the medium temperature portion may include refrigerated shelves used to hold produce. Refrigerant flows from receiver 125 to both the low temperature and medium temperature portions of the refrigeration system. For example, the refrigerant flows to low temperature low side heat exchanger 130 and medium temperature low side heat exchanger 135. When the refrigerant reaches low temperature low side heat exchanger 130 or medium temperature low side heat exchanger 135, the refrigerant removes heat from the air around low temperature low side heat exchanger 130 or medium temperature low side heat exchanger 135. As a result, the air is cooled. The cooled air may then be circulated such as, for example, by a fan to cool a space such as, for example, a freezer and/or a refrigerated shelf. As refrigerant passes through low temperature low side heat exchanger 130 and medium temperature low side heat exchanger 135, the refrigerant may change from a liquid state to a gaseous state as it absorbs heat. This disclosure contemplates including any number of low temperature low side heat exchangers 130 and medium temperature low side heat exchangers 135 in any of the disclosed cooling systems.

Refrigerant flows from low temperature low side heat exchanger 130 and medium temperature low side heat exchanger 135 to compressors 140 and 145. This disclosure contemplates the disclosed cooling systems including any number of low temperature compressors 140 and medium temperature compressors 145. Both the low temperature compressor 140 and medium temperature compressor 145 compress refrigerant to increase the pressure of the refrigerant. As a result, the heat in the refrigerant may become concentrated and the refrigerant may become a high-pressure gas. Low temperature compressor 140 compresses refrigerant from low temperature low side heat exchangers 130 and sends the compressed refrigerant to medium temperature compressor 145. Medium temperature compressor 145 compresses a mixture of the refrigerant from low temperature compressor 140 and medium temperature low side heat exchanger 135. Medium temperature compressor 145 then sends the compressed refrigerant to high side heat exchanger 105.

Air conditioning compressor 150 compresses the refrigerant from air conditioning low side heat exchanger 120 and/or receiver 125. As a result, the heat in the refrigerant may become concentrated and the refrigerant may become a high-pressure gas. Air conditioning compressor 150 may compress this refrigerant after the refrigerant travels through heat exchanger 110. Air conditioning compressor 150 discharges the compressed refrigerant to high side heat exchanger 105.

By integrating an air conditioning system and a refrigeration system, system 100 has a reduced footprint compared to a non-integrated and separate air conditioning system and refrigeration system. However, in some instances, system 100 performs less efficiently than the separate air conditioning and refrigeration systems. For example, on hot days, system 100 may perform less efficiently than separate air conditioning and refrigeration systems (e.g., 8-10% less efficiently than separate air conditioning and refrigeration systems). This disclosure contemplates certain modifications to system 100 that improve its efficiency. In these unconventional designs, the integrated air conditioning and refrigeration system can operate as efficiently, or even more efficiently, than separate air conditioning and refrigeration systems on hot days. The unconventional system will be described in more detail using FIGS. 2A, 2B, and 3.

FIG. 2A illustrates an example cooling system 200A. As seen in FIG. 2A, system 200A includes a high side heat exchanger 105, a heat exchanger 110, an expansion valve 115, an air conditioning low side heat exchanger 120, a receiver 125, a low temperature low side heat exchanger 130, medium temperature low side heat exchangers 135A and 135B, a low temperature compressor 140, a medium temperature compressor 145, an air conditioning compressor 150, a receiver 205, a valve 225, and a valve 230. In certain embodiments, system 200A improves the efficiency of an integrated air conditioning and refrigeration system such that system 200A performs as efficiently or more efficiently than separate air conditioning and refrigeration systems.

Generally, high side heat exchanger 105, heat exchanger 110, low temperature low side heat exchanger 130, medium temperature low side heat exchangers 135A and 135B, low temperature compressor 140, medium temperature compressor 145, and air conditioning compressor 150 operate similarly as they did in system 100. For example, high side heat exchanger 105 removes heat from a refrigerant. Heat exchanger 110 transfers heat from a refrigerant to the refrigerant from high side heat exchanger 105. Low temperature low side heat exchanger 130 and medium temperature low side heat exchangers 135A and 135B use a refrigerant to cool a space proximate those low side heat exchangers. Low temperature compressor 140 compresses the refrigerant from low temperature low side heat exchanger 130. Medium temperature compressor 145 compresses refrigerant from low temperature compressor 140 and medium temperature low side heat exchangers 135A and 135B. Air conditioning compressor 150 compresses refrigerant from heat exchanger 110.

A difference between system 200A and system 100 is that expansion valve 115 is adjusted to flood air conditioning low side heat exchanger 120. For example, expansion valve 115 may be opened more or opened fully to allow more refrigerant to be directed to air conditioning low side heat exchanger 120 through valve 115. As a result of the increased refrigerant flow to air conditioning low side heat exchanger 120, air conditioning low side heat exchanger 120 does not evaporate all of the refrigerant in air conditioning low side heat exchanger 120 as air conditioning low side heat exchanger 120 cools a space proximate air conditioning low side heat exchanger 120. Thus, the refrigerant leaving air conditioning low side heat exchanger 120 has both a vapor portion and a liquid portion.

The refrigerant from air conditioning low side heat exchanger 120 is directed to receiver 205. Receiver 205 stores the refrigerant from air conditioning low side heat exchanger 120. As seen in FIG. 2A, receiver 205 separates the refrigerant into a liquid portion 210 and a vapor portion 215. In some embodiments, receiver 205 uses gravity to separate the liquid portion 210 from the vapor portion 215. For example, gravity may pull the liquid portion 210 down towards the bottom of the receiver 205, while the vapor portion 215 flows upwards in the receiver 205. Similar to receiver 125, receiver 205 discharges the vapor portion 215 to heat exchanger 110 and air conditioning compressor 150. In this manner, an internal pressure of receiver 205 can be controlled.

In some embodiments, receiver 125 directs vapor refrigerant and/or a flash gas to receiver 205. Receiver 205 may direct this refrigerant or flash gas to heat exchanger 110 along with vapor portion 215. In this manner, an internal pressure of receiver 125 and/or receiver 205 can be controlled.

As air conditioning low side heat exchanger 120 directs more refrigerant to receiver 205, the liquid portion 210 in receiver 205 increases. To prevent receiver 205 from overflowing, receiver 205 includes a sensor 220 coupled to receiver 205. Sensor 220 detects a level of liquid portion 210 within receiver 205. Sensor 220 detects when liquid portion 210 exceeds or rises above a threshold. When liquid portion 210 exceeds the threshold, receiver 205 and/or system 200A may drain liquid portion 210 from receiver 205.

Valves 225 and 230 control the flow of refrigerant within system 200A. Valve 225 controls the flow of refrigerant from receiver 125 to low temperature low side heat exchanger 130 and medium temperature low side heat exchangers 135A and 135B. Valve 230 controls the flow of refrigerant from receiver 205 to low temperature low side heat exchanger 130 and medium temperature low side heat exchangers 135A and 135B. During regular operation, valve 225 is open and valve 230 is closed. Refrigerant from receiver 125 travels through valve 225 to low temperature low side heat exchanger 130 and medium temperature low side heat exchangers 135A and 135B. Low temperature low side heat exchanger 130 and medium temperature low side heat exchangers 135A and 135B use this refrigerant to cool spaces proximate those low side heat exchangers. Additionally, receiver 205 stores the refrigerant from air conditioning low side heat exchanger 120. The level of liquid portion 210 continues to increase within receiver 205.

When sensor 220 detects that liquid portion 210 exceeds or rises above a threshold within receiver 205, system 200A may transition to a second mode of operation in which liquid portion 210 is drained from receiver 205. During the second mode of operation, valve 225 closes and valve 230 opens. As a result, liquid portion 210 of the refrigerant in receiver 205 flows through valve 230 to low temperature low side heat exchanger 130 and medium temperature low side heat exchangers 135A and 135B. Low temperature low side heat exchanger 130 and medium temperature low side heat exchangers 135A and 135B use that refrigerant to cool spaces proximate those low side heat exchangers.

When the level of liquid portion 210 in receiver 205 falls below a certain threshold and/or when liquid portion 210 in receiver 205 is completely drained, system 200A may transition back to the regular mode of operation. Valve 225 opens and valve 230 closes. In certain embodiments, system 200A may transition back to the regular mode of operation after the second mode of operation has reached a certain duration. In other words, the transition from the second mode of operation to the regular mode of operation may occur after receiver 205 has drained for a certain period of time.

In particular embodiments, by flooding air conditioning low side heat exchanger 120 and storing liquid portion 210 in receiver 205 and by using liquid portion 210 during a second mode of operation, the efficiency of system 200A is improved.

In some embodiments, system 200A includes additional modifications that further improve the efficiency of system 200A. As seen in FIG. 2A, the refrigeration portion of system 200A includes heat exchangers 235A and 235B and expansion valves 240A, 240B, and 240C. Generally, expansion valves 240A, 240B, and 240C operate similarly as expansion valve 115 by further cooling refrigerant that flows through expansion valves 240A, 240B, and 240C. Heat exchangers 235A and 235B sub-cool refrigerant from medium temperature low side heat exchangers 135A and 135B before that refrigerant reaches medium temperature compressor 145. Specifically, heat exchangers 235A and 235B transfer heat from the refrigerant from medium temperature low side heat exchangers 135A and 135B to the refrigerant from receiver 125 and/or receiver 205. Heat exchangers 235A and 235B direct the refrigerant from receivers 125 and 205 to expansion valves 240A and 240B. Heat exchangers 235A and 235B direct the refrigerant from medium temperature low side heat exchangers 135A and 135B to medium temperature compressor 145. By subcooling the refrigerant from medium temperature low side heat exchangers 135A and 135B, the efficiency of medium temperature compressor 145 is improved.

In particular embodiments, by making these modifications to system 200A, the efficiency of system 200A is improved such that system 200A operates as efficiently as separate air conditioning and refrigeration systems, even on hot days.

FIG. 2B illustrates an example cooling system 200B. As seen in FIG. 2B, system 200B includes a high side heat exchanger 105, a heat exchanger 110, an expansion valve 115, an air conditioning low side heat exchanger 120, a receiver 125, a low temperature low side heat exchanger 130, medium temperature low side heat exchangers 135A and 135B, a low temperature compressor 140, a medium temperature compressor 145, an air conditioning compressor 150, heat exchangers 235A and 235B, and expansion valves 240A, 240B, and 240C. In particular embodiments, system 200B improves the efficiency of an integrated air conditioning and refrigeration system by flooding air conditioning low side heat exchanger 120.

Generally, the components of system 200B operate similarly as they did in system 200A. For example, high side heat exchanger 105 removes heat from a refrigerant. Heat exchanger 110 transfers heat from a refrigerant to the refrigerant from high side heat exchanger 105. Expansion valve 115 cools refrigerant flowing to air conditioning low side heat exchanger 120. Air conditioning low side heat exchanger 120 uses the refrigerant to cool a space proximate air conditioning low side heat exchanger 120. Receiver 125 stores refrigerant from high side heat exchanger 105. The stored refrigerant may include a liquid portion 210 and a vapor portion 215. Receiver 125 may discharge the vapor portion 215 to air conditioning compressor 150. Low temperature low side heat exchanger 130 and medium temperature low side heat exchangers 135A and 135B use the refrigerant from receiver 125 to cool spaces proximate those low side heat exchangers. Low temperature compressor 140 compresses the refrigerant from low temperature low side heat exchanger 130. Medium temperature compressor 145 compresses the refrigerant from medium temperature low side heat exchangers 135A and 135B and from low temperature compressor 140. Air conditioning compressor 150 compresses the refrigerant from receiver 125. Heat exchangers 235A and 235B transfer heat from the refrigerant from medium temperature low side heat exchangers 135A and 135B to the refrigerant from receiver 125. Expansion valves 240A, 240B, and 240C cool the refrigerant before the refrigerant reaches low temperature low side heat exchanger 130 and/or medium temperature low side heat exchangers 135A and 135B.

A difference between system 200B and system 200A is the removal of a receiver that stores only the refrigerant from air conditioning low side heat exchanger 120. Instead, in system 200B, the refrigerant from air conditioning low side heat exchanger 120 is directed to receiver 125. Similar to system 200A, air conditioning low side heat exchanger 120 is flooded such that the refrigerant from air conditioning low side heat exchanger 120 includes both a liquid portion and a vapor portion. Receiver 125 receives the refrigerant from high side heat exchanger 105 and air conditioning low side heat exchanger 120 and separates the refrigerant into liquid portion 210 and vapor portion 215. In particular embodiments, by removing the second receiver, system 200B has a lower cost than system 200A. However, it is more difficult in system 200B to control the level of liquid portion 210 in receiver 125. In certain instances, the level of liquid portion 210 in receiver 125 can only be controlled by adjusting expansion valve 115 to direct more or less refrigerant to air conditioning low side heat exchanger 120.

FIG. 3 is a flowchart illustrating a method 300 of operating an example cooling system. In particular embodiments, various components of system 200A and/or system 200B perform the steps of method 300. By performing method 300, the efficiency of an integrated air conditioning and refrigeration system is improved.

A high side heat exchanger begins by removing heat from a refrigerant in step 305. In step 310, an air conditioning low side heat exchanger uses the refrigerant to cool a space. Because the air conditioning low side heat exchanger is flooded, the refrigerant from the air conditioning low side heat exchanger includes both a liquid portion and a vapor portion. A receiver stores the refrigerant from the air conditioning low side heat exchanger in step 315. The receiver separates the refrigerant into a liquid portion and a vapor portion in step 320. In some embodiments, the receiver uses gravity to separate the liquid portion from the vapor portion. For example, gravity may pull the liquid portion down towards the bottom of the receiver, while the vapor portion flows upwards in the receiver.

In step 325, a sensor detects whether the liquid portion in the receiver exceeds a threshold. Based on this determination, the system operates either in a regular mode of operation or a second mode of operation. If the sensor detects that the liquid portion exceeds a threshold, the system may transition to a second mode of operation to drain the liquid portion from the receiver. In step 330, a first valve may be opened and in step 335 a second valve is closed. By opening the first valve, liquid refrigerant in the receiver is allowed to flow out of the receiver through the first valve. By closing the second valve, refrigerant in a separate receiver is prevented from flowing out of the receiver.

If the sensor detects that the liquid portion does not exceed the threshold, then the system may perform a regular mode of operation. In step 340, the first valve is closed and in step 345, the second valve is opened. By closing the first valve, the liquid portion of the refrigerant is prevented from flowing out of the receiver. By opening the second valve, refrigerant in a second receiver is allowed to flow out of that receiver.

In step 350, a low temperature low side heat exchanger uses refrigerant to cool a low temperature space. The refrigerant may come from the receiver that stores the refrigerant from the air conditioning low side heat exchanger or the second receiver that is used during the regular mode of operation. A medium temperature low side heat exchanger uses the refrigerant to cool a medium temperature space in step 355. A low temperature compressor compresses the refrigerant used to cool the low temperature space in step 360. In step 365, a medium temperature compressor compresses the refrigerant used to cool the medium temperature space and the compressed refrigerant from the low temperature compressor that was used to cool the low temperature space. In step 370, an air conditioning compressor compresses the vapor portion of the refrigerant from the receiver.

Modifications, additions, or omissions may be made to method 300 depicted in FIG. 3. Method 300 may include more, fewer, or other steps. For example, steps may be performed in parallel or in any suitable order. While discussed as system 200 (or components thereof) performing the steps, any suitable component of system 200 may perform one or more steps of the method.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

This disclosure may refer to a refrigerant being from a particular component of a system (e.g., the refrigerant from the high side heat exchanger, the refrigerant from the receiver, etc.). When such terminology is used, this disclosure is not limiting the described refrigerant to being directly from the particular component. This disclosure contemplates refrigerant being from a particular component (e.g., the high side heat exchanger, the receiver, etc.) even though there may be other intervening components between the particular component and the destination of the refrigerant. For example, the air condition low side heat exchanger receives a refrigerant from the high side heat exchanger even though there may be a heat exchanger and a valve between the air conditioning low side heat exchanger and the high side heat exchanger.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. An apparatus comprising:

a high side heat exchanger configured to remove heat from a refrigerant;

an air conditioning low side heat exchanger configured to use the refrigerant from the high side heat exchanger to cool a space proximate the air conditioning low side heat exchanger;

a first receiver configured to store the refrigerant from the air conditioning low side heat exchanger, the refrigerant from the air conditioning low side heat exchanger comprising a liquid portion and a vapor portion;

a second receiver configured to store the refrigerant from the high side heat exchanger;

a first low side heat exchanger;

a second low side heat exchanger;

a first valve configured to control a flow of the liquid portion of the refrigerant from the first receiver to the first and second low side heat exchangers;

a second valve configured to control a flow of the refrigerant from the second receiver to the first and second low side heat exchangers;

a first compressor configured to compress the refrigerant from the first low side heat exchanger;

a second compressor configured to compress the refrigerant from the first compressor and the second low side heat exchanger; and a third compressor configured to compress the vapor portion of the refrigerant from the first receiver, wherein during a first mode of operation:

the first valve is closed;

the second valve is open;

the first low side heat exchanger configured to use the refrigerant from the second receiver to remove heat from a first space proximate the first low side heat exchanger; and the second low side heat exchanger configured to use the refrigerant from the second receiver to remove heat from a second space proximate the second low side heat exchanger; and wherein during a second mode of operation:

the first valve is open;

the second valve is closed;

the first low side heat exchanger configured to use the liquid portion of the refrigerant from the first receiver to remove heat from the first space; and the second low side heat exchanger configured to use the liquid portion of the refrigerant from the first receiver to remove heat from the second space.

2. The apparatus of claim 1, further comprising a heat exchanger configured to:

transfer heat from the refrigerant from the second low side heat exchanger to the refrigerant from the second receiver during the first mode of operation; and transfer heat from the refrigerant from the second low side heat exchanger to the liquid portion of the refrigerant from the first receiver during the second mode of operation.

3. The apparatus of claim 1, further comprising a heat exchanger configured to transfer heat from the vapor portion of the refrigerant from the first receiver to the refrigerant from the high side heat exchanger.

4. The apparatus of claim 1, wherein the second receiver is further configured to direct a flash gas from the second receiver to the first receiver.

5. The apparatus of claim 1, the first receiver further configured to separate the liquid portion from the vapor portion.

6. The apparatus of claim 1, further comprising a sensor coupled to the first receiver, the sensor configured to detect a level of the liquid portion of the refrigerant in the first receiver.

7. The apparatus of claim 6, wherein a transition from the first mode of operation to the second mode of operation occurs when the detected level of the liquid portion of the refrigerant in the first receiver exceeds a threshold.

8. A method comprising:

removing, by a high side heat exchanger, heat from a refrigerant;

using, by an air conditioning low side heat exchanger, the refrigerant from the high side heat exchanger to cool a space proximate the air conditioning low side heat exchanger;

storing, by a first receiver, the refrigerant from the air conditioning low side heat exchanger, the refrigerant from the air conditioning low side heat exchanger comprising a liquid portion and a vapor portion;

storing, by a second receiver, the refrigerant from the high side heat exchanger;

controlling, by a first valve, a flow of the liquid portion of the refrigerant from the first receiver to a first low side heat exchanger and a second low side heat exchanger;

controlling, by a second valve, a flow of the refrigerant from the second receiver to the first and second low side heat exchangers;

compressing, by a first compressor, the refrigerant from the first low side heat exchanger;

compressing, by a second compressor, the refrigerant from the first compressor and the second low side heat exchanger; and compressing, by a third compressor, the vapor portion of the refrigerant from the first receiver;

using, by the first low side heat exchanger, the refrigerant from the second receiver to remove heat from a first space proximate the first low side heat exchanger during a first mode of operation;

using, by the second low side heat exchanger, the refrigerant from the second receiver to remove heat from a second space proximate the second low side heat exchanger during the first mode of operation, wherein the first valve is closed and the second valve is open during the first mode of operation;

using, by the first low side heat exchanger, the liquid portion of the refrigerant from the first receiver to remove heat from the first space during a second mode of operation; and using, by the second low side heat exchanger, the liquid portion of the refrigerant from the first receiver to remove heat from the second space during the second mode of operation, wherein the first valve is open and the second valve is closed during the second mode of operation.

9. The method of claim 8, further comprising:

transferring, by a heat exchanger, heat from the refrigerant from the second low side heat exchanger to the refrigerant from the second receiver during the first mode of operation; and transferring, by the heat exchanger, heat from the refrigerant from the second low side heat exchanger to the liquid portion of the refrigerant from the first receiver during the second mode of operation.

10. The method of claim 8, further comprising transferring, by a heat exchanger, heat from the vapor portion of the refrigerant from the first receiver to the refrigerant from the high side heat exchanger.

11. The method of claim 8, further comprising directing, by the second receiver, a flash gas from the second receiver to the first receiver.

12. The method of claim 8, further comprising separating, by the first receiver, the liquid portion from the vapor portion.

13. The method of claim 8, further comprising detecting, by a sensor coupled to the first receiver, a level of the liquid portion of the refrigerant in the first receiver.

14. The method of claim 13, further comprising transitioning from the first mode of operation to the second mode of operation occurring when the detected level of the liquid portion of the refrigerant in the first receiver exceeds a threshold.

15. An apparatus comprising:

a high side heat exchanger configured to remove heat from a refrigerant;

an air conditioning low side heat exchanger configured to use the refrigerant from the high side heat exchanger to cool a space proximate the air conditioning low side heat exchanger;

a receiver configured to store the refrigerant from the air conditioning low side heat exchanger and the refrigerant from the high side heat exchanger, the refrigerant from the air conditioning low side heat exchanger comprising a liquid portion and a vapor portion;

a first valve disposed between the high side heat exchanger and the air conditioning low side heat exchanger configured to produce a separate flow of refrigerant to the air conditioning low side heat exchanger from a flow of refrigerant directed to the receiver, wherein the first valve is configured to control a level of the liquid portion of the refrigerant stored in the receiver, wherein the receiver is configured to store both the flow of refrigerant from the high side heat exchanger and the separate flow of refrigerant from the air conditioning low side heat exchanger;

a first low side heat exchanger configured to use the refrigerant from the receiver to cool a first space proximate the first low side heat exchanger;

a second low side heat exchanger configured to use the refrigerant from the receiver to cool a second space proximate the second low side heat exchanger;

a first compressor configured to compress the refrigerant from the first low side heat exchanger;

a second compressor configured to compress the refrigerant from the first compressor and the second low side heat exchanger; and a third compressor configured to compress a vapor portion of the refrigerant from the receiver.

16. The system of claim 15, further comprising a heat exchanger configured to transfer heat from the vapor portion of the refrigerant from the receiver to the refrigerant from the high side heat exchanger.

17. The system of claim 15, the receiver further configured to separate the liquid portion of the refrigerant from the air conditioning low side heat exchanger from the vapor portion of the refrigerant from the air conditioning low side heat exchanger.

18. The system of claim 15, the second and third compressors configured to direct compressed refrigerant to the high side heat exchanger.

19. The system of claim 15, further comprising a heat exchanger configured to transfer heat from the refrigerant from the second low side heat exchanger to the refrigerant from the receiver.

20. The system of claim 19, wherein the heat exchanger is further configured to direct the refrigerant from the second low side heat exchanger to the second compressor.

* * * * *